US010962330B2

(12) United States Patent
Senn

(10) Patent No.: US 10,962,330 B2
(45) Date of Patent: Mar. 30, 2021

(54) SYSTEM AND METHOD FOR ALIGNING A VERTICAL AND/OR HORIZONTAL RETICLE OF AN OPTICAL DEVICE

(71) Applicant: Anthony Joseph Senn, Nampa, ID (US)

(72) Inventor: Anthony Joseph Senn, Nampa, ID (US)

(73) Assignee: Inventure Engineering and Machine, LLC, Boise, ID (US)

( * ) Notice: Subject to any disclaimer, the term of this patent is extended or adjusted under 35 U.S.C. 154(b) by 153 days.

(21) Appl. No.: 15/976,862

(22) Filed: May 10, 2018

(65) Prior Publication Data

US 2018/0328696 A1 Nov. 15, 2018

Related U.S. Application Data

(60) Provisional application No. 62/504,678, filed on May 11, 2017.

(51) Int. Cl.
*F41G 1/54* (2006.01)

(52) U.S. Cl.
CPC ..... *F41G 1/545* (2013.01)

(58) Field of Classification Search
CPC ..... F41G 1/44; F41G 1/545; F41G 1/54
USPC ..... 33/298, 299, 568, 573
See application file for complete search history.

(56) References Cited

U.S. PATENT DOCUMENTS 712,420 A * 10/1902 Scott ..... F41G 1/44 89/200
2,243,793 A * 5/1941 Cummins ..... F41G 1/38 42/122
2,854,748 A * 10/1958 Williams ..... F41G 11/002 42/126
4,700,489 A * 10/1987 Vasile ..... G01B 3/566 33/342
5,127,167 A * 7/1992 Kennedy ..... G01C 9/28 33/370
6,510,615 B1 * 1/2003 Budd ..... G01B 11/26 33/286
7,065,890 B1 * 6/2006 Chang ..... G01C 15/004 33/227
8,240,075 B1 * 8/2012 Mullin ..... F41G 11/003 42/119
8,528,140 B1 * 9/2013 Phillips ..... F41G 11/003 12/111
8,819,985 B1 * 9/2014 McCoy ..... F41G 1/54 42/111
2003/0146355 A1 * 8/2003 Burr ..... A47B 91/066 248/188.4

(Continued)

*Primary Examiner* — Christopher W Fulton
(74) *Attorney, Agent, or Firm* — Hogaboam Law Offices, PLLC; Romney J. Hogaboam

(57) ABSTRACT

A device and method for aligning a sighting device with a reference. The device includes features conforming to an industry standard for attaching accessories to a firearm. The device contains features which allow the device to be leveled relative to a removable level. A sighting device may be attached to the device using the industry standard features. Once attached, the sighting device may then be aligned using either the removable level or an external reference. Once the sighting device is secured in its mount, the mounted sight may then be installed and removed from one or more devices without its calibrated orientation being altered.

17 Claims, 9 Drawing Sheets

(56) References Cited

U.S. PATENT DOCUMENTS

2012/0297659 A1* 11/2012 Lattimer ..... F41G 1/38
42/122

* cited by examiner

SYSTEM AND METHOD FOR ALIGNING A VERTICAL AND/OR HORIZONTAL RETICLE OF AN OPTICAL DEVICE

CROSS-REFERENCE TO RELATED APPLICATIONS

This application claims priority provisional application 62/504,678 filed on May 11, 2017.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

REFERENCE TO A "SEQUENCE LISTING," A TABLE, OR A COMPUTER PROGRAM LISTING APPENDIX SUBMITTED ON COMPACT DISC AND AN INCORPORATION-BY-REFERENCE OF THE MATERIAL ON THE COMPACT DISC

Not Applicable

STATEMENT REGARDING PRIOR DISCLOSURES BY AN INVENTOR OR JOINT INVENTOR

Not Applicable

BACKGROUND OF THE INVENTION

Sighting devices are frequently used in scientific and sporting activities. Sighting devices are frequently detachable from the devices they are configured to aim. This allows users to select sighted devices and sighting devices separately and thereby customize sighted devices and sighting devices to their specific needs and desires. This also allows people to use one sighting device, which may be expensive relative to the cost of the sighted device, on multiple sighted devices. One good example of a sighted device is a rifle and a good example of a sighting device is a rifle scope containing a reticle. A common rule of thumb is that a rifle scope cost as much as, or more than, the rifle to which it is attached. Many rifles are configured with features which allow a sighting device to be attached to the rifle. These features vary and may include relatively simple holes which have been drilled and tapped in the firearm, integrated rails which conform to standardized specifications, and specialized mounting brackets among others.

Sighting devices, regardless of whether they are for sporting or scientific purposes, may often be used at various distances. Sighting devices are very often used on a sight line which is different from the sighted device. When the sighting and sighted devices have different sight lines, they will not be precisely aimed at the same point at different distances. For that reason, and others, many sighting devices are configured with a reticle containing graduations and are also configured with adjustment features to allow features in the sighting device to be moved relative to the sighted device such that features in the sighting device can be moved to a desirable point relative to the sighted device.

In the example of rifles, a scope (sighting device) is frequently mounted above the bore of the rifle (sighted device). The scope is often configured with crosshairs having one or more line(s) intended to be used in a vertical orientation and one or more line(s) configured intended to be used in a horizontal orientation. A scope is also often configured with a body consisting significantly of a cylindrical tube. A cylindrical tube presents a variety of optical, manufacturing, cost, and installation advantages. From an installation viewpoint, the cylindrical tube also allows a wide variety of installation orientations since the cylindrical tube may be rotated relative to mounting hardware configured to clamp the cylindrical tube allowing very flexible orientation. This flexibility comes with a trade-off of requiring care when installing a scope if one wishes the scope to be aligned with a particular reference.

Scopes are frequently configured with independent adjustments at right angles to each other. One adjustment, intended for horizontal adjustment, is often called the windage adjustment. A second adjustment, intended for vertical adjustment, is often called the elevation adjustment. When a scope is mounted, calibrated to level, adjustment of the elevation adjustment will move the reticle vertically but not horizontally. Similarly, adjustment of the windage adjustment will move the reticle horizontally but not vertically. If the scope is not mounted level, adjustment of either the windage or elevation adjustments will move the reticle both horizontally and vertically. If the scope is only slightly off-center and/or the scope is used at short distances, the undesired horizontal movement when manipulating the elevation adjustment may be difficult to detect. However, at longer distances the error is magnified.

Due to the importance of having a scope which is mounted level there are a variety of devices and methods which have been developed to aid in leveling a scope. These devices and methods generally involve multiple references. For example, one method is to place a firearm in a vice, manipulate the vice until a feature in the firearm is level, place the scope on the firearm, rotate the scope until a feature, such as the turret cover, is level and then finish mounting the scope. Another method is to place a firearm in a vice, manipulate the vice until a feature in the firearm is level, place the scope on the firearm, rotate the scope until a reference feature such as a plumb bob viewed through the scope is aligned with a feature in the reticle, then finish mounting the scope.

Certain specialized devices have also been designed to aid in aligning a sighting device to an external reference. One such set of devices is a set of levels. A firearm is placed in a vice and the vice is manipulated until a feature on the firearm is level as indicated by a first level. A second level is attached to the firearm barrel and adjusted until the second level is level while the first level is also level. A scope is placed on the firearm and the scope is manipulated until first level placed on a feature is level while the second level is also level. The scope is then finally mounted. Another conventional specialized device designed to aid in aligning an aiming device to an external reference is commonly known as the Dead Level sold by Badger Ordinance. It is a triangular platform with a Picatinny rail attached, two leveling feet, and an attached bullseye level. A scope may be mounted in a scope mount and attached to the Picatinny rail of the device. The device may be leveled by adjusting the leveling feet until the bullseye level reads level in the X and Y axes. One may then look through the scope at an external reference and rotate the scope as necessary until a reticle in the scope is aligned with the external reference viewed through the scope.

BRIEF SUMMARY OF THE INVENTION

The present invention is a device and method for aligning a sighting device with an external reference. The invention comprises a device which is configured to be adjustable to align it with an external reference. The device also comprises features which allow a sighting device to be attached, directly or indirectly, to the device. When the sighting device is attached to the device, the sighting device can be adjusted to align features of the sighting device with either the device or an external reference.

DETAILED DESCRIPTION OF THE INVENTION

Embodiments are discussed with reference to the accompanying figures, which depict one or more examples of embodiments. Embodiments may be implemented in many different forms and should not be construed as limited to the embodiments set forth herein, shown in the figures, and/or described below. Rather, these examples of embodiments are provided to allow a complete disclosure that conveys the principles of the invention to those of skill in the art.

Figure 1:
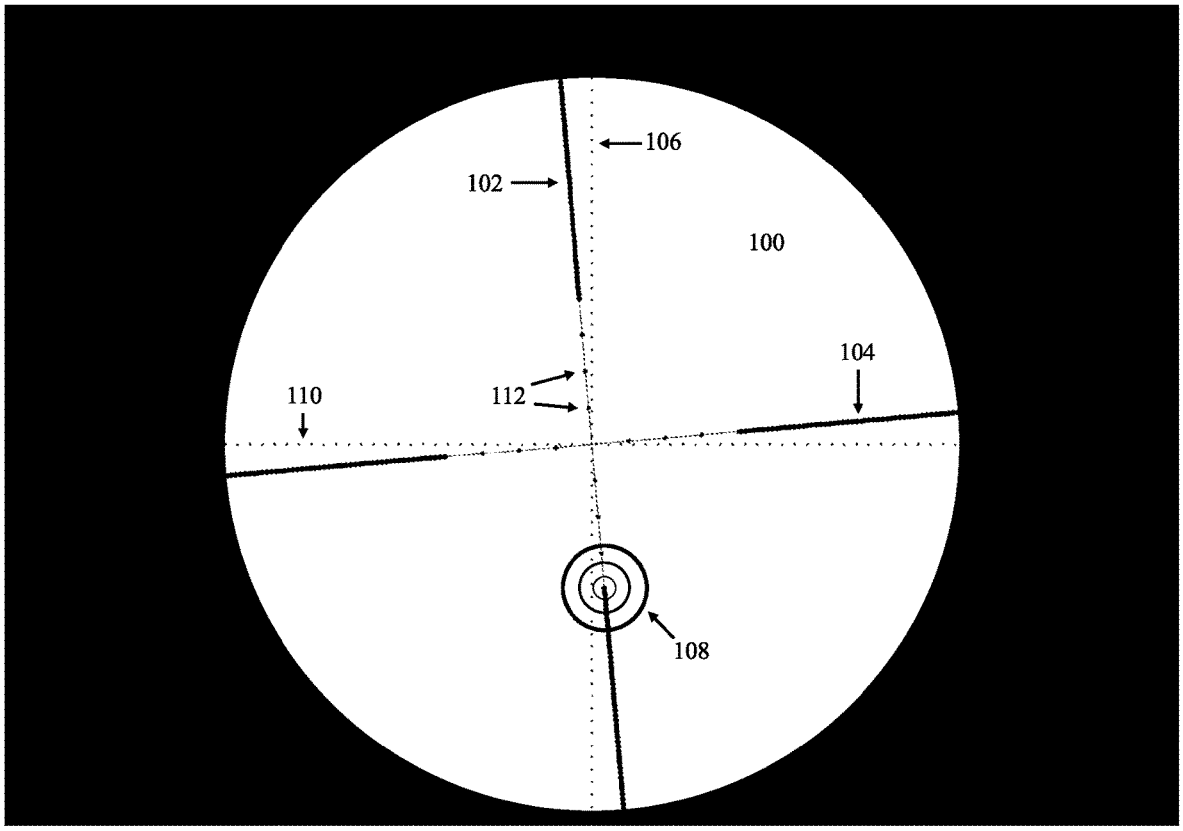
FIG. 1 depicts a view through a sighting device in which the reticle has not been aligned with a vertical reference.

FIG. 1 illustrates an example of a misaligned reticle for an optical device, such as a firearm scope, and illustrates how misalignment of a reticle of the optical device can result in misplaced or poorly placed shots on a distant target. The reticle 100 includes a vertical crosshair 102 and a horizontal crosshair 104, according to one embodiment. When the vertical crosshair 102 is aligned with a vertical reference 106, and the horizontal crosshair 104 is aligned with a horizontal reference 110, then the likelihood of introducing misalignment-based windage errors into shots on a distant target 108 is reduced. As an example, if a reticle of an optical device is misaligned by 3 degrees of rotation, a windage error of 10-30 inches can be introduced into a 1000 yard shot (depending upon the external ballistics of the bullet being fired). It is common practice to adjust an optical device for elevation using markings 112 on the vertical element of the crosshairs 102 of the reticle 100 to compensate for elevation losses, or bullet drop, because using lines or dots of the vertical crosshairs 102 to adjust for bullet drop can decrease the time needed to adjust for a particular distance when compared to dialing necessary adjustments on an elevation adjustment knob. As shown in FIG. 1, the vertical crosshair 102 has been moved to a line on the reticle that corresponds to a hypothetical adjustment for the magnification of the optical device and for a distance (e.g., 1000 yards) of the target 108. As can be seen from FIG. 1, the vertical crosshair 102 of the reticle 100 is misaligned with a vertical reference 106, which shows an example error that might not be noticed, recognized, or known by a marksman. The resulting windage error that is introduced purely by misalignment of the optical device can make shots at distant targets even more challenging than they inherently are. The optical device alignment tool disclosed herein provides a solution to the misalignment of the vertical crosshair 102 of a reticle 100 of an optical device, which reduces the likelihood of introducing a windage error due to rotational misalignment of an optical device mounted on a firearm. Although the term firearm is generally used to refer to handguns, rifles, or other devices that use gaseous expansion to propel a projectile, as used herein, a firearm is meant to include a crossbow, an archery bow, or any other device onto which an optical device having reticle would be mounted and used for target acquisition, according to one embodiment.

Figure 2:
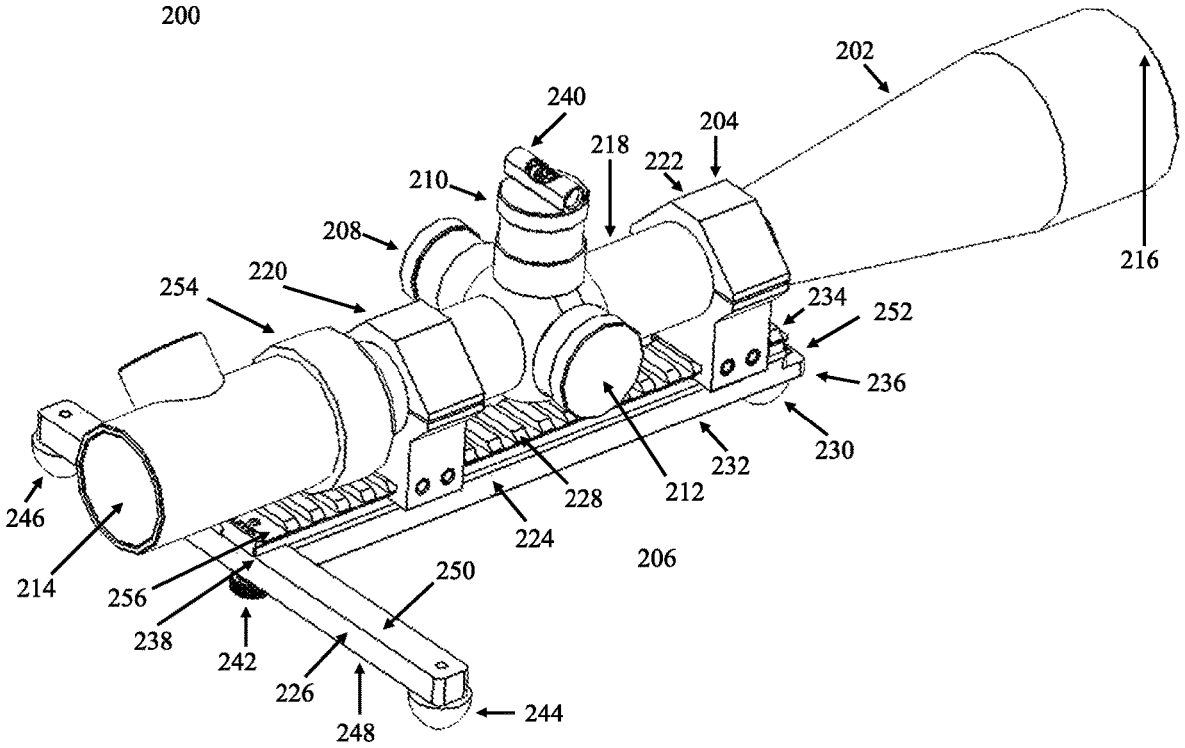
FIG. 2 depicts a device of the applicant's invention. A levelable base is shown with a sighting device attached to the device of the applicant's invention by means of scope rings.

FIG. 2 illustrates an optical device alignment system 200, which includes an optical device 202, one or more optical device mounts 204, and an optical device alignment tool 206, according to one embodiment. The optical device 202 enables a user of the optical device to view and, with some optical devices, magnify distant objects to improve the user's ability to view the object or details of the object. The optical device 202 is a firearm scope having a magnification adjustment 254, a parallax adjustment (turret) 208, an elevation adjustment (turret) 210, a windage adjustment (turret) 212, an ocular lens 214 (within an eyepiece), an objective lens (not shown) within an objective bell 216, a reticle (not shown), and a main tube 218, according to one embodiment.

The one or more optical device mounts 204 maintain the position of the optical device 202 relative to a rail, a firearm, or some other base to which the one or more optical device mounts 204 are attached, according to one embodiment. The one or more optical device mounts 204 include a first optical device mount 220 and a second optical device mount 222, according to one embodiment. The first optical device mount 220 is coupled to the main tube 218 proximate to the eyepiece or ocular lens 214, and the second optical device mount 222 is coupled to the main tube 218 proximate to the objective lens 216, according to one embodiment. The one or more optical device mounts 204 are scope rings adapted to prevent displacement of the optical device 202 by clamping around the main tube 218, according to one embodiment. The one or more optical mounts 204 each include a base configured to be secured onto a rail, a firearm, or some other base, according to one embodiment. One example of a rail that the one or more optical device mounts 204 can be configured to be mounted to is a Picatinny rail, according to one embodiment.

The optical device alignment tool 206 includes a main-support member 224 and a cross-support member 226 for providing a stable adjustable platform onto which the optical device 202 is mounted and is aligned in the one or more optical device mounts 204, according to one embodiment. The optical device alignment tool 206 enables a user to temporarily attach an optical device 202 to the optical device alignment tool 206 with the one or more optical device mounts 204, in order to rotationally align a reticle of the optical device 202 in the one or more optical device mounts 204, according to one embodiment. Once the optical device 202 is rotationally aligned in the one or more optical device mounts 204, the one or more optical device mounts 204 are detached from the optical device alignment tool 206 and are attached to a rifle or other firearm for use and/or for elevation and windage zeroing, according to one embodiment. Elevation and windage zeroing includes aligning the crosshair of the reticle of the optical device with the barrel or muzzle of the firearm such that a projectile discharged from the firearm strikes a target at a predetermined distance from the firearm at a desirable location when viewing the target through the optical device, according to one embodiment.

The main-support member 224 is a beam that includes a rail 228 and a first leveling foot 230, according to one embodiment. The main-support member 224 is a beam that is a square beam, substantially a square beam, cylindrical, substantially cylindrical, a prism, or other straight beam shape. The main-support member 224 is manufactured from one or more of metals, plastics, composites, and similar materials. The main-support 224 includes a lower surface 232, an upper surface 234, a first end 236, and a second end 238, according to one embodiment. The lower surface 232 includes an opening or aperture that is configured to receive and store a level 240 and is configured to mate with a surface of the cross-support member 226 in a stowed configuration for the optical device alignment tool 206, according to one embodiment. The upper surface 234 includes the rail 228 and is configured to mate with the one or more optical device mounts 204, according to one embodiment. The upper surface 234 is illustrated with the rail 228 being a Picatinny rail, however, other types of firearm accessory rails (e.g., Weaver, NATO accessory rail, KeyMod, Arca-Swiss, and M-LOK) that are currently in use or yet to be developed may also be used, according to various embodiments.

The first end 236 includes an aperture into which the first leveling foot 230 is screwed or otherwise mounted into place, according to one embodiment. The first leveling foot 230 is screwed into the main-support member 224 on the lower surface 232 and proximate to the first end 236, according to one embodiment. The first end also includes a surface 252 adapted to support a level 240, in certain embodiments.

The second end 238 of the main-support member is removably coupled to the cross-support member 226, to provide a stable platform for the optical device 202, according to one embodiment. The second end 238 includes one or more apertures for removably coupling the cross-support member 226 to the main-support member 224, according to one embodiment. The second end 238 also includes a surfaces 256 adapted to support a level 240, in certain embodiments. The optical device alignment tool 206 includes a retention device 242 that is a thumb screw for conveniently and toollessly attaching and detaching the cross-support member 226 to the main-support member 224, according to one embodiment. In FIG. 2, the optical device alignment tool 206 is illustrated in an operational configuration, wherein the cross-support member 226 is substantially perpendicular to the main-support member 224, according to one embodiment. As illustrated in later figures, the cross-support member 226 is configured such that it is detachable from the main-support member 224, and is re-attachable to the main support member 224 in a stowed configuration, wherein the cross-support member 226 is substantially parallel to the main-support member 224 to reduce the amount of space needed to store and/or transport the optical device alignment tool 206, according to one embodiment.

The cross-support member 226 is a beam that includes a second leveling foot 244, a third leveling foot 246, a lower surface 248, and an upper surface 250, according to one embodiment. The cross-support member 226 is a beam that is a square beam, substantially a square beam, cylindrical, substantially cylindrical, a prism, or other straight beam shape. The cross-support member 226 is manufactured from one or more of metals, plastics, composites, and similar materials, according to various embodiments. In one embodiment, the cross-support member 226 is an arcuate beam that curves towards or away from the first end 236 of the main-support member 224, according to one embodiment. The second leveling foot 244 and/or the third leveling foot 246 are attached to the cross-support member 226 so that one or more of the second leveling foot 244 and the third leveling foot 246 can be manipulated to raise or lower each end of the cross-support member 226. In a preferred embodiment, the second leveling foot 244 and/or the third leveling foot 246 are attached to cross-support member 224 by a threaded member, such as a screw, whereby rotating a leveling foot relative to cross-support member 226 increases or decreases the distance of an end of the cross support member 226 from the surface on which the optical device alignment tool is placed. The second leveling foot 244 and/or the third leveling foot 246 are used to make the optical device alignment tool 206 level, with respect to the level 240, regardless of the surface that the optical device alignment tool 206 is placed upon, according to one embodiment. One of the second leveling foot 244 and the third leveling foot 246 may be fixed, while the other is coupled into the cross-support member 226 in a manner allowing its distance of the cross-support member 226 from the surface to be adjusted, according to one embodiment.

Although the optical device 202 is oriented such that the eyepiece is proximate to the cross-support member 226 and the objective bell is distant to the cross-support member 226, the opposite orientation is also possible, according to one embodiment. That is, the optical device 202 can be oriented in the opposite direction, such that the objective bell is proximate to the cross-support member 226 and the eyepiece is distant to the cross-support member 226.

In order for the reticle of an optical device to be horizontally and vertically aligned relative to the surface to which it will be mounted, the optical device alignment system need only be level perpendicular to the length of the rail. However, leveling foot 230 allows the user to level the optical device alignment tool along the length of the rail. When shooting a rifle at long distances, a projectile will drop substantially below the point of at which the bore of the rifle is aimed. To compensate for this drop, shooters will often adjust their optical device to point where the projectile should strike, rather than a point substantially close to where the bore of the rifle is aimed. Optical devices have a limited amount of adjustment. At some distance, the point where a projectile will land will be outside the adjustable range of the optical device. To increase the range of adjustment, some shooters use a sloped mount. The amount of slope in these mounts is generally measured in minute of angle (MOA) with 20, 30, and 40 MOA mounts being available. The amount of slope in some devices may not be well marked and may be unknown in certain circumstances. By measuring the slope of a mount installed on a rail which is level lengthwise, one can determine the slope of that mount.

Figure 3:
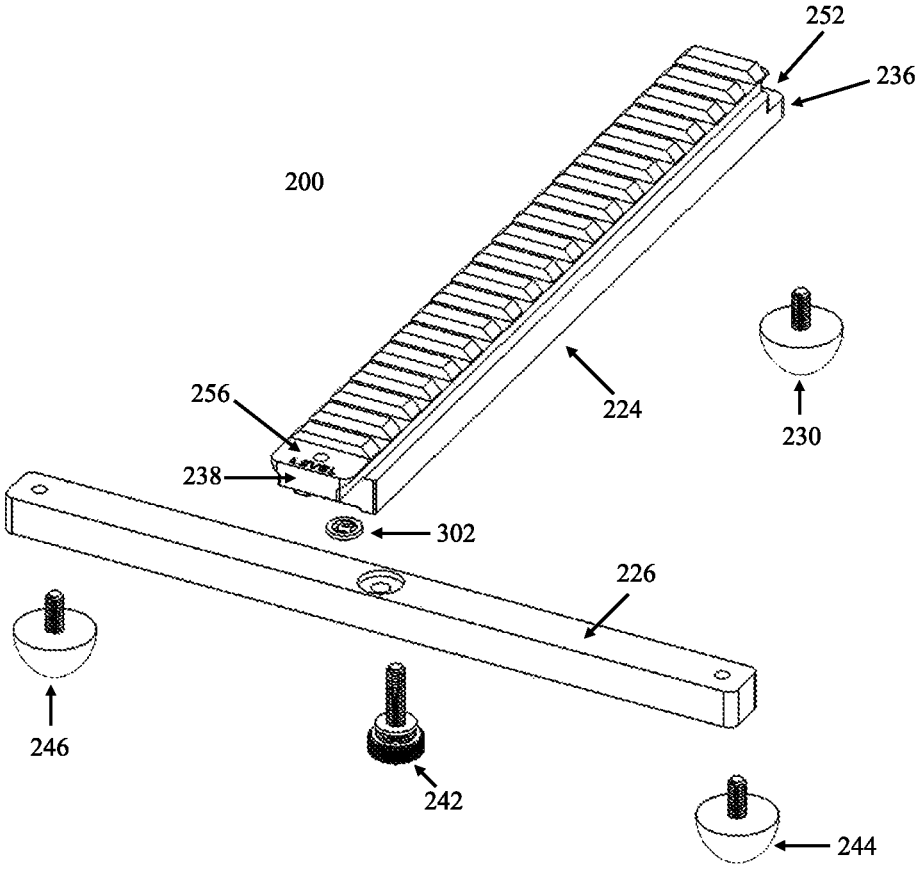
FIG. 3 depicts an exploded view of a device of the applicant's invention.

FIG. 3 illustrates an exploded view of the optical device alignment system 200, according to one embodiment. As illustrated, the optical device alignment system 200 includes a screw retainer 302 that prevents the retention device 242 (e.g., a metal screw) from falling out of the cross-support member 226 while the cross-support member 226 is decoupled from the main-support member 224, according to one embodiment. As further illustrated, the main support member 224 is configured with one or more features (252 near a first end 236 and 256 near a second end 238) adapted to support a level, in certain embodiments.

Figure 4:
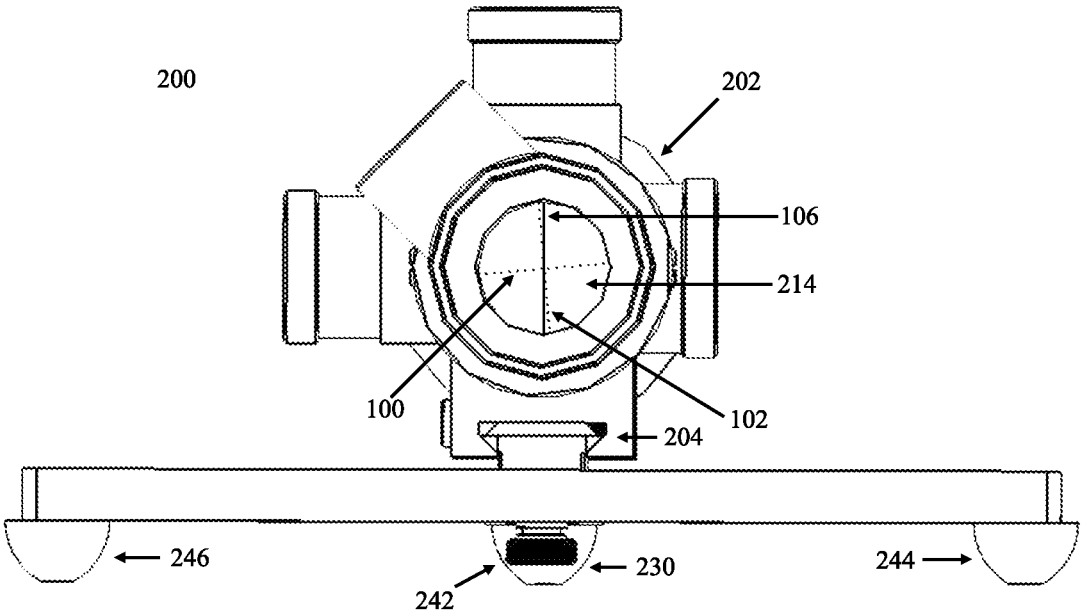
FIG. 4 depicts a device of the applicant's invention with a sighting device attached to the device of the applicant's invention by means of scope rings. The ocular end of the sighting device is shown with a reticle and vertical reference visible through the ocular lens.

FIG. 4 illustrates a view of the optical device alignment system 200 from the viewpoint of the ocular lens 214, according to one embodiment. As illustrated, the optical device 202 includes a reticle 100 disposed within the optical device 202 between the ocular lens 214 and the objective lens (not shown) of the optical device 202, according to one embodiment. As illustrated, the optical device 202 is misaligned because the vertical crosshair 102 of the reticle 100 is misaligned with a vertical reference 106, according to one embodiment.

The vertical reference 106 can be created or obtained using a variety of techniques, according to one embodiment. The vertical reference 106 represents a zenith of the Earth's surface or a reference that is perpendicular to a point on the Earth's surface that is in line with the intersection of the vertical crosshair 102, according to one embodiment. The vertical reference 106 can include, but is not limited to, a doorjamb, a light pole, a plumb line (suspended string with one end weighted), a line on a wall, and any other vertical or substantially vertical reference that can be viewed through the optical device 202, according to one embodiment.

The optical device 202, in the illustrated example is rotated clockwise to align the vertical crosshair 102 of the reticle 100 with the vertical reference 106, according to one embodiment. To be able to rotate and realign the optical device 202 with the one or more optical device mounts, screws, clamps, or other retention devices on the one or more optical mounts are loosened, the optical device 202 is rotated, then the screws, clamps or other retention devices on the one or more optical mounts are tightened, to secure the alignment of the optical device 202 with the vertical reference 106 and/or to secure the alignment of the optical device 202 with the one or more optical device mounts 204, according to one embodiment.

In one embodiment, the optical device alignment system 200 enables a user to determine and remedy misalignment using one or more horizontal references (not shown) in addition to, or in place of, the vertical reference 106. The one or more horizontal references include, but are not limited to, a horizon (e.g., an ocean, another body of water, or a land horizon), a horizontal line on a wall, a horizontally (and straight) extended string, rope, cable, level, or other material, a roof-line of a building, or a similarly straight horizontal reference, according to various embodiments.

Figure 5:
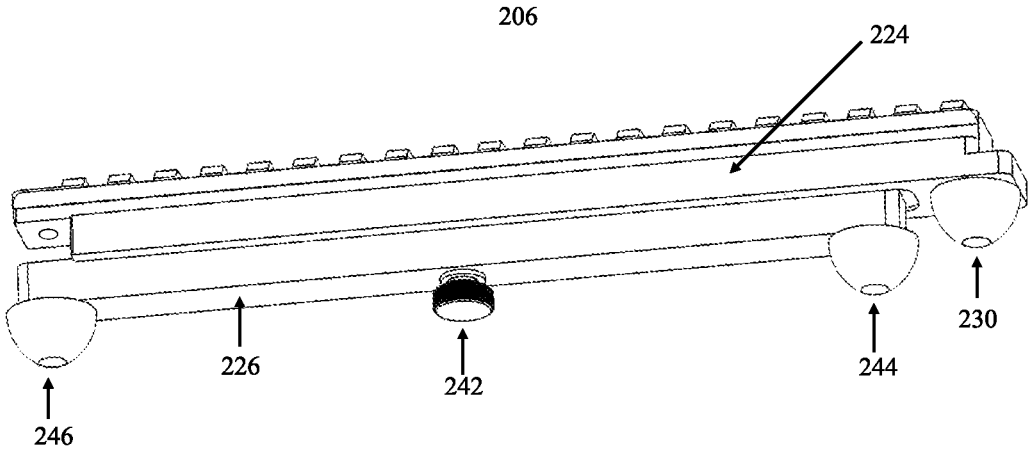
FIG. 5 depicts the applicant's invention in its storage configuration.

FIG. 5 illustrates a stowed configuration of the optical device alignment tool 206, according to one embodiment. The cross-support member 226 is removably coupled to the main-support member 224 with the retention device 242 in a stowed configuration, to facilitate storage and transport of the optical device alignment tool 206, according to one embodiment.

Figure 6:
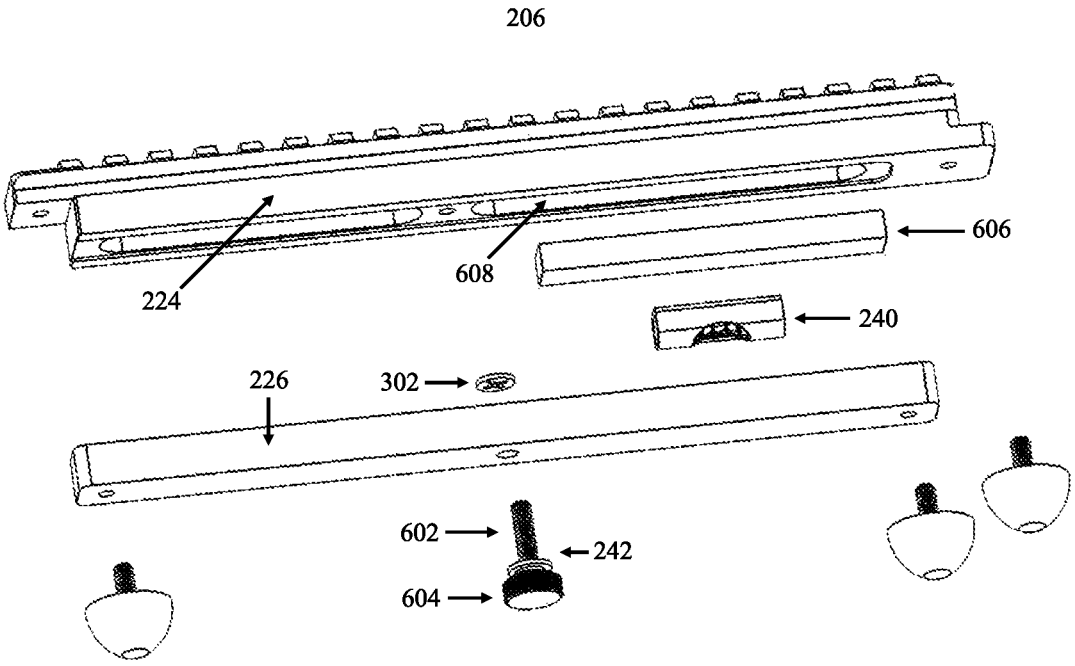
FIG. 6 depicts an exploded view of the applicant's invention in its storage configuration.

FIG. 6 illustrates an exploded view of the optical device alignment tool 206, according to one embodiment. As illustrated, the retention device 242 includes a threaded screw 602 and a thumb screw head 604, to facilitate the manipulation of the retention device 242 and to facilitate coupling and decoupling the cross-support member 226 to the main-support member 224, according to one embodiment. The retention device further includes a thumbscrew retainer 302, in certain embodiments. Flexible material 606, such as foam, may be installed in an aperture 608 of the main-support member 224 to provide a tight fit between the cross-support member 226 and the level 240 when the device alignment tool 206 is in a stowed configuration.

Figure 7:
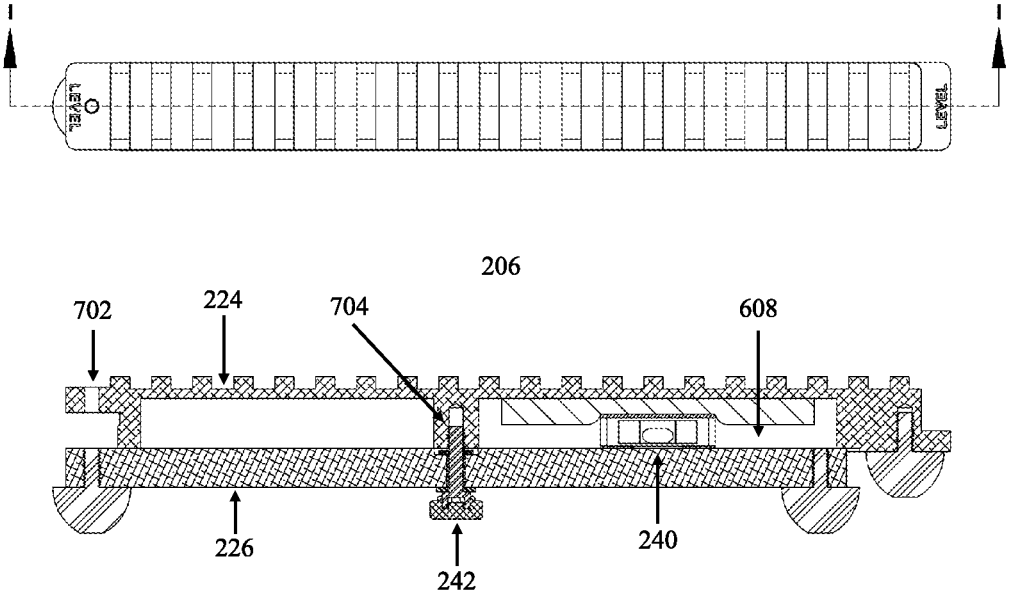
FIG. 7 depicts a vertical cross-sectional view of the applicant's invention in a storage configuration bisected lengthwise.

FIG. 7 illustrates a cross-sectional view of the stowed configuration of the optical device alignment tool 206, according to one embodiment. As shown, the main-support member 224 includes an aperture 704 and an aperture 702 configured to secure the cross-support member 226 to the main-support member 224 with the retention device 242, in the stowed configuration or in the operational configuration respectively, according to one embodiment. FIG. 7 further illustrates an aperture, cavity, or opening 608 within the main-support member 224 configured such that the level 240 may be stowed with the optical device alignment tool 206, in between the cross-support member 226 and the main-support member 224, while in the stowed configuration, according to one embodiment. The aperture, cavity, or opening 608 may include shock absorption material 606 (e.g., foam) that reduces the potential for damage to the level 240 while the level 240 is in the aperture, cavity, or opening 608, while the optical device alignment tool 206 is in the stowed configuration, according to one embodiment.

Figure 8:
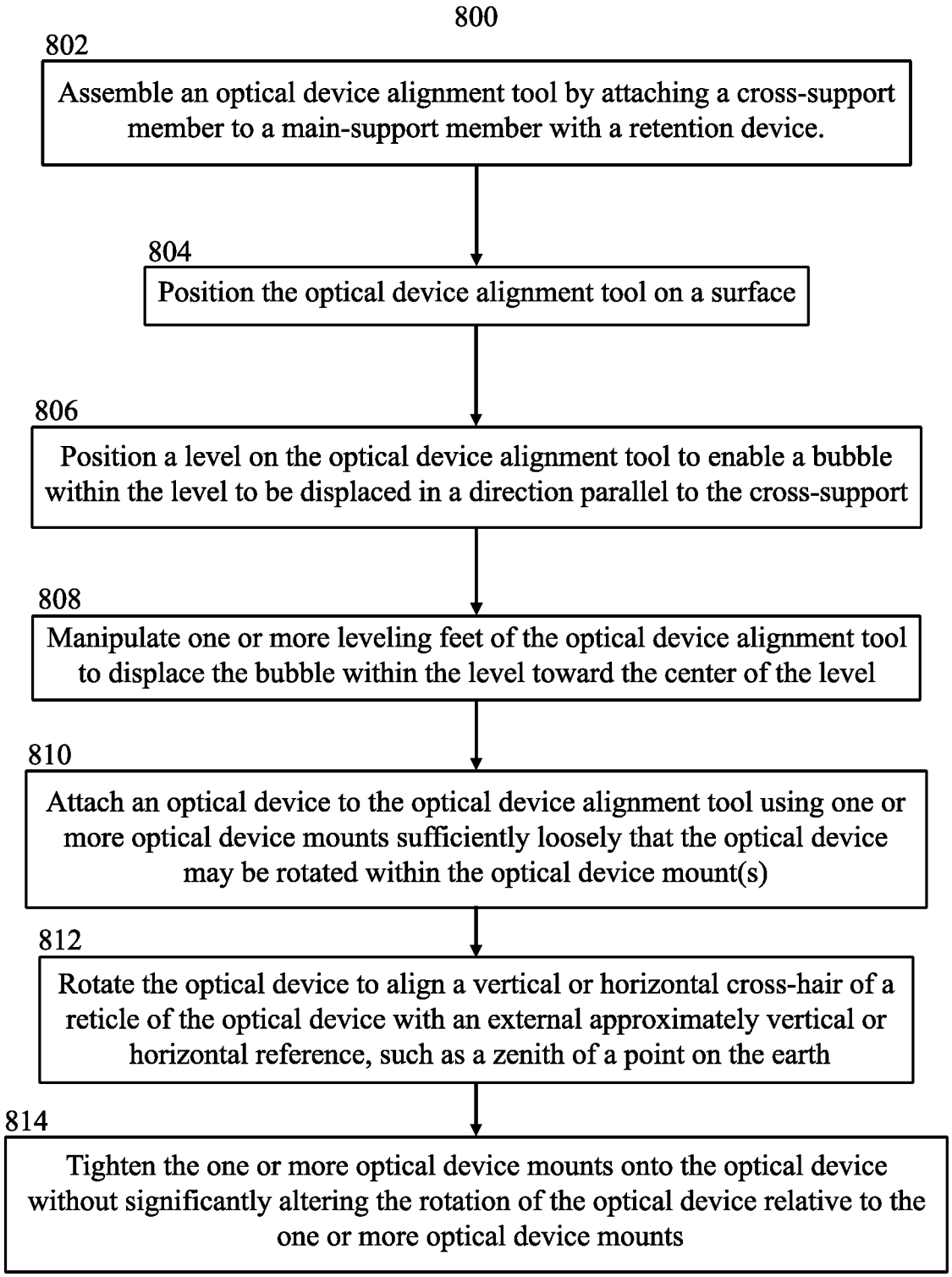
FIG. 8 depicts a method of using a device of the applicant's invention to align a sighting device using an external reference.

FIG. 8 illustrates a method 800 of operating the optical device alignment system, according to one embodiment. The operations of the method 800 are described in one example of an order of operations, for illustration purposes. However, the operations of the method 800 may be performed in one or more of a number of different orders, according to various embodiments.

At operation 802, the process 800 includes assembling an optical device alignment tool by attaching a cross-support member to a main-support member with a retention device, according to one embodiment. Operation 802 proceeds to operation 804, according to one embodiment.

At operation 804, the process 800 includes positioning the optical device alignment tool on a surface, according to one embodiment. The surface can be a bench, a table, the ground, a floor, or any other surface, for aligning the optical device with one or more optical device mounts or with one or more vertical references, according to one embodiment. Operation 804 proceeds to operation 806, according to one embodiment.

At operation 806, the process 800 includes positioning a level on the optical device alignment tool to enable a bubble within the level to be displaced in a direction that is parallel to the cross-support, according to one embodiment. In one embodiment, the level is positioned on a rail of the main-support member. In one embodiment, the level is positioned on the cross-support member. The level is positioned on the optical device alignment tool to allow the bubble to move in a direction that is perpendicular to the length of the main-support member and parallel to the cross-support member, according to one embodiment. Operation 806 proceeds to operation 808, according to one embodiment.

At operation 808, the process 800 includes manipulating one or more leveling feet of the optical device alignment tool to displace the bubble within the level towards the center of the level, according to one embodiment. In one embodiment, one or more of the leveling feet are rotatably manipulated (e.g. screwed in or out) to level the optical device alignment tool. Operation 808 proceeds to operation 810, according to one embodiment.

At operation 810, the process 800 includes attaching an optical device to the optical device alignment tool using one or more optical device mounts. The optical device is mounted in the optical device mount(s) sufficiently loosely the optical device may be rotated in the optical device mount(s). Operation 810 proceeds to operation 812, according to one embodiment.

At operation 812, the process 800 includes aligning a vertical and/or horizontal crosshair of a reticle of the optical device to be perpendicular or parallel to the optical device alignment tool, by rotating the optical device clockwise and/or counterclockwise, to cause the vertical and/or horizontal crosshair of the reticle of the optical device to be approximately parallel or perpendicular with a zenith of a point on Earth that is in front of an intersection of the vertical crosshair and a horizontal crosshair of the optical device, according to one embodiment. Operation 812 proceeds to operation 814, according to one embodiment.

At operation 814, the process 800 includes tightening the one or more optical device mounts onto the optical device without significantly altering the rotation of the optical device relative to the optical device mount(s). This may involve tightening screws in the mounts according to an alternating pattern, applying pressure onto the optical device as screws in the mounts are tightened, or any of a variety of other techniques. The process may be repeated as necessary, loosening and tightening the optical device mounts on the optical device until the optical device has been secured in the optical device mounts with the reticle aligned as set forth in operation 812.

Figure 9:
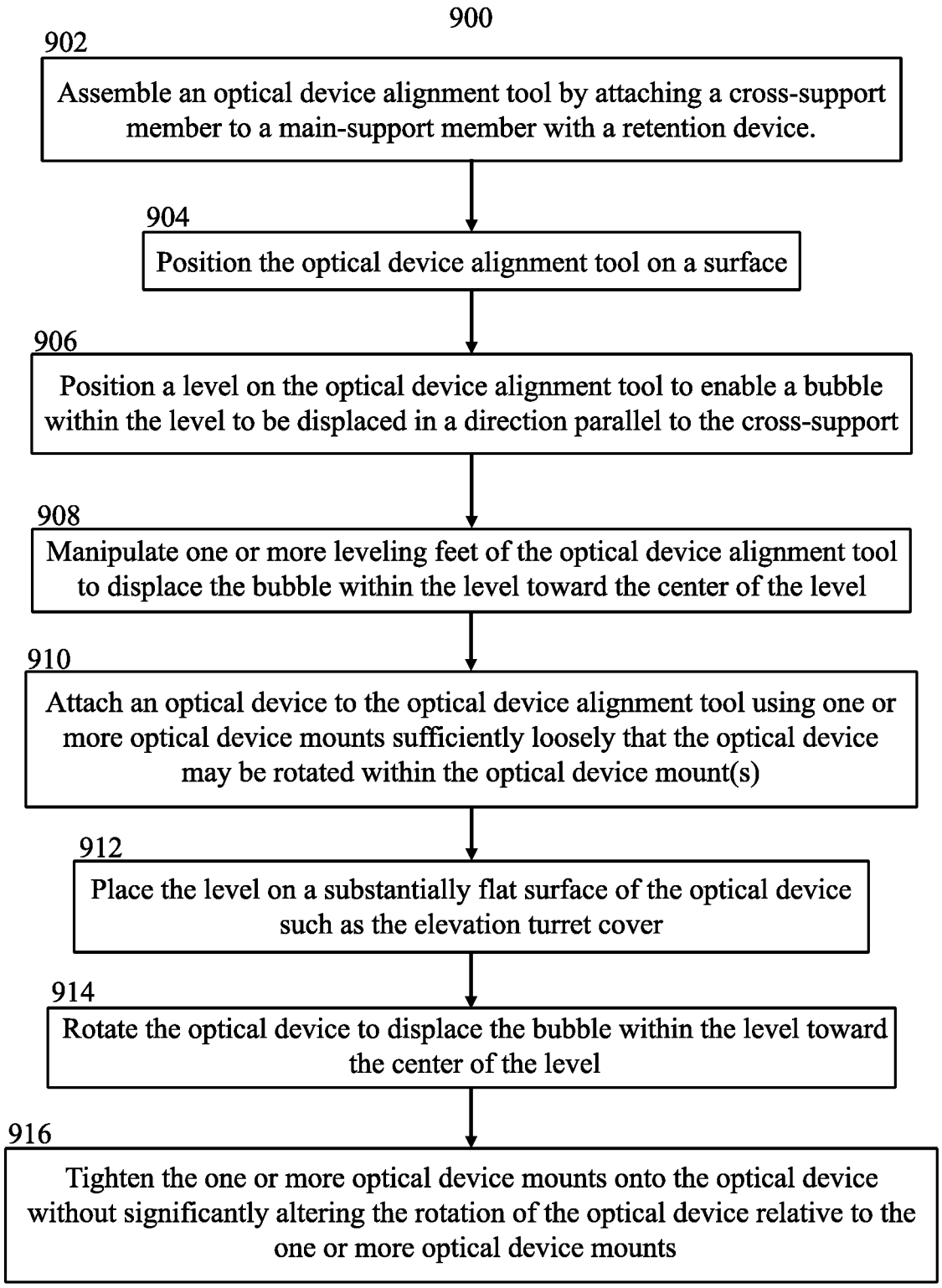
FIG. 9 depicts a method of using a device of the applicant's invention to align a sighting device without using an external reference.

FIG. 9 illustrates a method 900 of operating the optical device alignment system, according to one embodiment. The operations of the method 900 are described in one example of an order of operations, for illustration purposes. However, the operations of the method 900 may be performed in one or more of a number of different orders, according to various embodiments.

At operation 902, the process 900 includes assembling an optical device alignment tool by attaching a cross-support member to a main-support member with a retention device, according to one embodiment. Operation 902 proceeds to operation 904, according to one embodiment.

At operation 904, the process 900 includes positioning the optical device alignment tool on a surface, according to one embodiment. The surface can be a bench, a table, the ground, a floor, or any other surface, for aligning the optical device with one or more optical device mounts or with one or more vertical references, according to one embodiment. Operation 904 proceeds to operation 906, according to one embodiment.

At operation 906, the process 900 includes positioning a level on the optical device alignment tool to enable a bubble within the level to be displaced in a direction that is parallel to the cross-support, according to one embodiment. In one embodiment, the level is positioned on a rail of the main-support member. In one embodiment, the level is positioned on the cross-support member. The level is positioned on the optical device alignment tool to allow the bubble to move in a direction that is perpendicular to the main-support member and in parallel with the cross-support member, according to one embodiment. Operation 906 proceeds to operation 908, according to one embodiment.

At operation 908, the process 900 includes manipulating one or more leveling feet of the optical device alignment tool to displace the bubble within the level to a reference reading, according to one embodiment. In one embodiment, one or more of the leveling feet are rotatably manipulated (e.g., screwed in or out) to level the optical device alignment tool. Operation 908 proceeds to operation 910, according to one embodiment.

At operation 910, the process 900 includes attaching an optical device to the optical device alignment tool using one or more optical device mounts. The optical device is mounted in the optical device mount(s) sufficiently loosely the optical device may be rotated in the optical device mount. Operation 910 proceeds to operation 912, according to one embodiment.

At operation 912, the process 900 includes positioning a level, preferably the same level which was used in operation 906, on an approximately flat horizontal surface of the optical device and preferably in the same orientation. As long as the manufacturer of the optical device has installed the horizontal cross-hair parallel to the approximately flat horizontal surface, the approximately flat horizontal surface is a reasonable approximation for the horizontal reticle crosshair. The approximately flat horizontal surface is the elevation adjustment turret cover, according to one embodiment. Operation 912 proceeds to operation 914, according to one embodiment.

At operation 914, the process 900 includes rotating the optical device, clockwise or counterclockwise as necessary, to displace the bubble of the level to a reference reading. Operation 914 proceeds to operation 916, according to one embodiment.

At operation 916, the process 900 includes tightening the one or more optical device mounts onto the optical device without significantly altering the rotation of the optical device relative to the optical device mount(s). This may involve tightening screws in the mounts according to an alternating pattern, applying pressure onto the optical device as screws in the mounts are tightened, or any of a variety of other techniques. The process may be repeated as necessary, loosening and tightening the optical device mounts on the optical device until the optical device has been secured in the optical device mounts with the reticle aligned as set forth in operation 914.

When leveling both the optical device alignment tool in operation 908 and the optical device in operation 914, the level need not read level in either operation. Rather, as long as the level reads the same in both operations, and the level is used in the same orientation in both operations, the optical device will be level relative to the optical device alignment tool. This allows lower cost levels to be used as accuracy of the level is much less important than precision to achieve a high degree of accuracy in mounting the optical device. As used in this application, a reference reading is defined as a reading on the level which is the same when the level is placed on the optic device alignment tool and when the level is placed on a feature on the optical device.

Although rotational calibration of the optical device to align horizontal and/or vertical features of a reticle with an external reference is of primary interest for many purposes, length-wise calibration of the optical device alignment tool is of interest for certain functions also. The optical device alignment tool may be leveled in the direction of the length of the top surface by placing a leveling device on the top surface of the main support member and parallel to the length of the main support member. A user may then manipulate one or more leveling feet of the optical device alignment tool to displace a bubble within the level to a level reading. A user may then, with a length reference such as a tape measure, at a known distance such as 200 yards, from the reference level optical device alignment tool, adjust their optical device a known amount (e.g. 20 MOA up). The user may measure the distance the point of aim displaces at the known distance to calculate the accuracy of the scope adjustments. Although the displacement difference between 1) a calibrated level and 20 MOA above calibrated level and 2) 10 MOA below a calibrated level and 10 MOA above a calibrated level is small, there is a difference in offset when one is using a flat tape measure. Using a vertical tape measure set on a curve having radius equal to the distance from the optical device to the tape measure would eliminate this difference, but the difficulty in setting the proper curve to tape measure over a distance great enough to observe errors in the offset is a difficult task in other than a purpose-built facility.

As noted above, the specific illustrative examples discussed above are but illustrative examples of implementations of embodiments. Those of skill in the art will readily recognize that other implementations and embodiments are possible. Therefore the discussion above should not be construed as a limitation on the claims provided below.

What is claimed is:

1. An apparatus for aligning an optical device with an external reference comprising:

a) a first member comprising:

1) a top surface comprising features adapted to mechanically couple with features of an optical mount, 2) a bottom surface, and 3) one or more features configured to allow a second member to be removably attached to the first member at two or more mutually exclusive locations;

b) the second member comprising:

1) a top surface, 2) a bottom surface, and 3) one or more features configured to allow the second member to be removably attached to the first member, 4) one or more adjustable-length members extending below the bottom surface; and c) a level indicator not permanently attached to the first member or second member.

2. The apparatus of claim 1 wherein the level indicator is a single-axis level selected from the following:

a) a tubular spirit level, b) a ball inclinometer, and c) an electronic level.

3. The apparatus of claim 2 wherein the one or more adjustable-length features comprise threaded rods configured to thread into a one or more threaded apertures in the second member.

4. The apparatus of claim 3 wherein the adjustable-length features further comprise at least partially rounded feet attached to the threaded rods.

5. The apparatus of claim 3 wherein the adjustable-length features further comprise a foot containing an elastomer attached to the threaded rods.

6. The apparatus of claim 2 wherein the bottom surface of the first member is configured with a cavity extending toward the top surface of the first member.

7. The apparatus of claim 6 wherein the cavity in the bottom surface of the first member is configured to permit the level indicator to fit inside the cavity when the second member is removably attached to the first member at a first location.

8. The apparatus of claim 7 wherein the one or more features configured to allow a second member to be removably attached to the first member in two or more mutually exclusive locations comprise threaded apertures.

9. The apparatus of claim 8 wherein the first member and second member are substantially parallel when the second member is removably attached to the first member at the first location.

10. The apparatus of claim 9 wherein the second member substantially covers the cavity in the first member when the second member is removably attached to the first member at the first location.

11. The apparatus of claim 10 wherein the features in the top surface of the first member adapted to mechanically couple with features of an optical mount comport to a specification selected from the following:

a) M1913 Picatinny, b) M-LOK, c) Weaver, and d) Arca-Swiss.

12. The apparatus of claim 11 wherein the first member further comprises one or more surfaces configured to support placement of the level indicator.

13. The apparatus of claim 9 wherein the first member and second member are substantially perpendicular when the second member is removably attached to the first member at a second location.

14. The apparatus of claim 1 wherein the first member further comprises one or more adjustable-length members extending below the bottom surface.

15. The apparatus of claim 1 wherein the top surface and the bottom surface of the first member are connected by substantially parallel and vertical sides.

16. A method for aligning an optical device with an external reference comprising:

a) assembling an optical device alignment tool;

b) placing a level indicator on the optical device alignment tool;

c) manipulating a one or more leveling features of the optical device alignment tool to cause the level indicator to indicate a reference reading;

d) attaching an optical device to the optical device alignment tool using one or more optical device mounts wherein the connection between the optical device and the optical device mount(s) is sufficiently loose so that the optical device may be rotated within the one or more optical device mounts;

f) placing the level indicator on an approximately flat horizontal surface of the optical device;

g) rotating the optical device relative to the one or more optical device mounts until the level indicator indicates a reference reading; and h) tightening the one or more optical device mounts onto the optical device without significantly altering the rotation of the optical device relative to the one or more optical device mounts.

17. A method for aligning an optical device with an external reference comprising:

a) assembling an optical device alignment tool;

b) placing a level indicator on the optical device alignment tool;

c) manipulating one or more leveling features of the optical device alignment tool to cause the level indicator to indicate level;

d) attaching an optical device to the optical device alignment tool using one or more optical device mounts wherein the connection between the optical device and the optical device mount(s) is sufficiently loose the optical device may be rotated within the one or more optical device mounts;

e) rotating the optical device relative to the one or more optical device mounts until features in the optical device are aligned with one or more reference features viewed through the optical device; and f) tightening the one or more optical device mounts onto the optical device without significantly altering the rotation of the optical device relative to the one or more optical device mounts.

* * * * *